US007503082B2

(12) United States Patent
Castellote

(10) Patent No.: US 7,503,082 B2
(45) Date of Patent: Mar. 17, 2009

(54) AIR MASSAGE SYSTEM FOR BATHTUB

(75) Inventor: Miguel Castellote, Sainte-Marguerite-de-Dorchester (CA)

(73) Assignee: C. G. Air Systèmes Inc., Ste-Marguerite-de-Dorchester (CA)

( * ) Notice: Subject to any disclaimer, the term of this patent is extended or adjusted under 35 U.S.C. 154(b) by 165 days.

(21) Appl. No.: 10/991,363

(22) Filed: Nov. 19, 2004

(65) Prior Publication Data

US 2005/0172393 A1 Aug. 11, 2005

Related U.S. Application Data

(63) Continuation-in-part of application No. 10/289,910, filed on Nov. 7, 2002, now abandoned, which is a continuation of application No. 09/549,881, filed on Apr. 17, 2000, now abandoned.

(30) Foreign Application Priority Data

Apr. 16, 1999 (CA) ..... 2,269,307

(51) Int. Cl.
*A61H 33/06* (2006.01)

(52) U.S. Cl. ..... 4/541.5; 137/389

(58) Field of Classification Search ..... 4/541.1–541.5
See application file for complete search history.

(56) References Cited

U.S. PATENT DOCUMENTS 3,986,217 A 10/1976 Doerr et al.
4,166,296 A 9/1979 Darrah et al.
4,237,562 A 12/1980 DuPont
4,316,484 A * 2/1982 De Frees ..... 137/389
4,325,149 A 4/1982 Moreland
4,510,967 A * 4/1985 Spinnett ..... 137/389
4,901,379 A 2/1990 Chalberg et al.
5,406,654 A * 4/1995 Antoine ..... 4/541.4

* cited by examiner

*Primary Examiner*—Charles E Phillips
(74) *Attorney, Agent, or Firm*—Ogilvy Renault LLP

(57) ABSTRACT

An air massage system for a bathtub comprises a blower, an air distributor and the water jets. The air distributor connects the blower to the jets, and the jets are adapted to deliver air under pressure to the cavity defined by the bathtub. The jets include water check valves to prevent the water in the bathtub from entering the air distributor. The air distributor comprises at least one water relief valve for preventing water from reaching the blower, when inoperative, in the event of failure of any one of the water check valves. The air distributor also comprises a main pipe, a manifold and distribution pipes, with the main pipe connecting the blower to the manifold and the distribution pipes connecting the manifold to the jets. The water relief valve is provided on the manifold, and the water check valves are provided on the manifold and at each jet. A pressure relief valve is provided upstream of the jets for keeping a substantially steady pressure from the air propelled by the blower.

9 Claims, 9 Drawing Sheets

AIR MASSAGE SYSTEM FOR BATHTUB

CROSS-REFERENCE TO RELATED APPLICATIONS

This application is a continuation-in-part of U.S. patent application Ser. No. 10/289,910, filed on Nov. 7, 2002, now abandoned which is a continuation of U.S. patent application Ser. No. 09/549,881, filed on Apr. 17, 2000 now abandoned. This application claims priority on Canadian Patent Application No. 2,269,307, filed on Apr. 16, 1999.

BACKGROUND OF THE INVENTION

1. Field of the Invention

The present invention relates to bathtubs and, more particularly, to air massage systems therefor.

2. Description of the Prior Art

Air Systems

Two types of air systems exist on the market.

1) The Channel System: This system consists in making a fiberglass air cavity surrounding the bathtub. Thirty to ninety holes of +/−⅛" of diameter are then drilled through the bathtub. Air is directly propelled in the cavity by a blower and then escapes by each of the holes to create turbulence in the water.

2) The System Connected to the Drain: This system operates with big jets without valves, in order to evacuate the water that stays in the air conduits, a part of the piping is connected to the drain of the bathtub. When the user opens the drain to empty the bathtub, a valve is automatically opened to also drain the piping.

Manifold

The prior systems include only one valve which may be a check valve or a "Hartford-loop", the "Hartford-loop" being an assembly of pipes creating a vacuum that can be compared to a bathtub or toilet bowl siphon.

SUMMARY OF THE INVENTION

It is therefore an aim of the present invention to provide an improved bathtub air massage system.

It is also an aim of the present invention to provide a bathtub air massage system that comprises a blower, an air distribution network and water jets to expel water under pressure in the bathtub's cavity.

It is a further aim of the present invention to provide a bathtub air massage system that comprises a water relief valve downstream of the blower to evacuate, for instance, water backflow, e.g., in the event of malfunction of check valves provided at the jets.

Therefore, in accordance with the present invention, there is provided an air massage system for a bathtub comprising a blower, an air distributor, and water jets, said air distributor being adapted to connect said blower to said jets, said jets being adapted to deliver air under pressure to the cavity defined by the bathtub, said air distributor comprising a manifold having a water check valve for generally preventing water from reaching said blower, and at least one water relief valve for draining water from said manifold, in the event that water infiltrates said manifold upstream of the water check valve in said manifold.

BRIEF DESCRIPTION OF DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
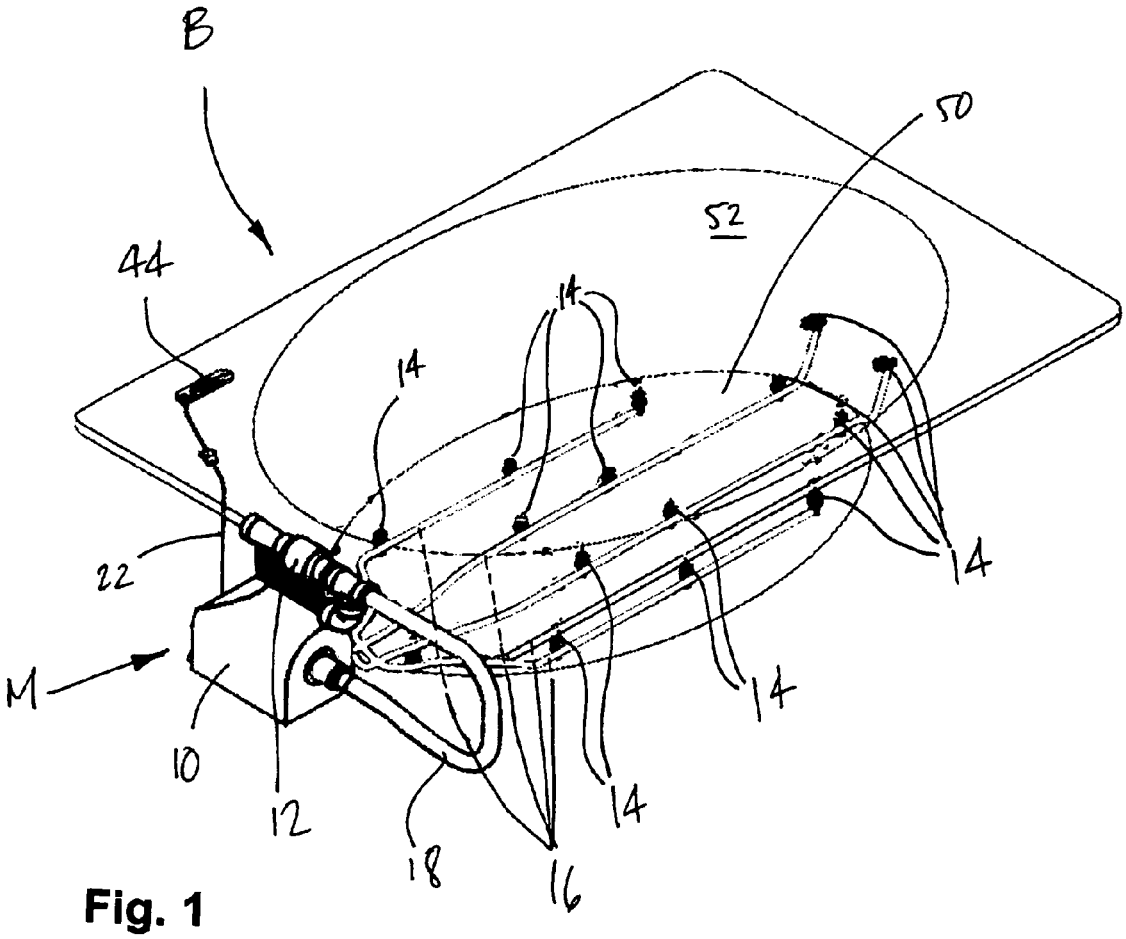
FIG. 1 is a schematic perspective view of part of a bathtub provided with an air massage system in accordance with the present invention, wherein water jets of the system are provided at the bottom of the bathtub.

In accordance with the present invention, FIG. 1 illustrates an air massage system M for a bathtub B. The main components of the air massage system M for the bathtub B are the following:

- a blower 10 provided with a heating element;
- an electronic controller 22 or starting system for the blower;
- a manifold 12 (i.e., and air distributor) equipped with one or many security valves, such as a check valve, a water relief valve and a pressure relief valve, which are described in more detail hereinafter;
- jets 14, with or without water check valves.

The jets 14 are also referred to as water jets and water air jets herein, but the jets 14 are jets injecting air in a fluid such as water;

- a flexible pipe 16 extending between the manifold 12 and the jets 14; and
- a flexible or rigid pipe 18 to connect the manifold 12 to the blower 10.

The functioning principle of the present air massage system M for the bathtub B is as follows. Ambient air is sucked in the blower 10 and heated by its heating element to then reach, via the pipe 18, the manifold 12 wherein air is distributed in the flexible pipes 16 to finally be blown and exit the system through the jets 14, which are located either at a bottom 50 of the bathtub B (see the air massage system M of FIG. 1) or on the lateral walls 52 of the bathtub B (see a second air massage system M' of the present invention shown in FIG. 2).

Step by Step

1. The blower 10 is activated by an electronic controller 22 or a mural timer.

Figure 7:
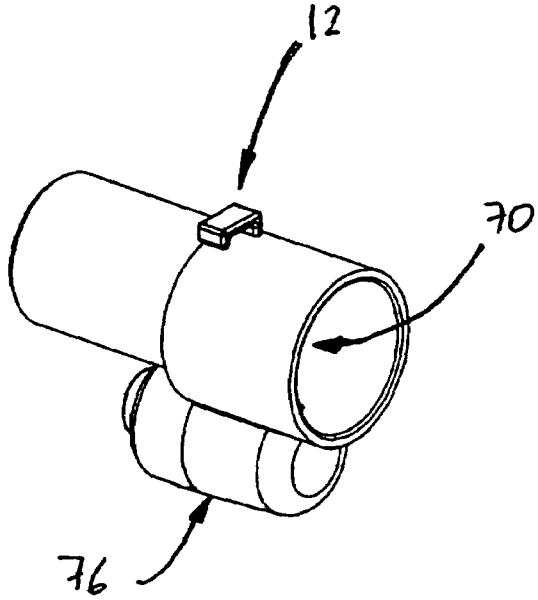
FIG. 7 is an enlarged perspective view of the manifold of the air massage system of FIG. 1.
Figure 8:
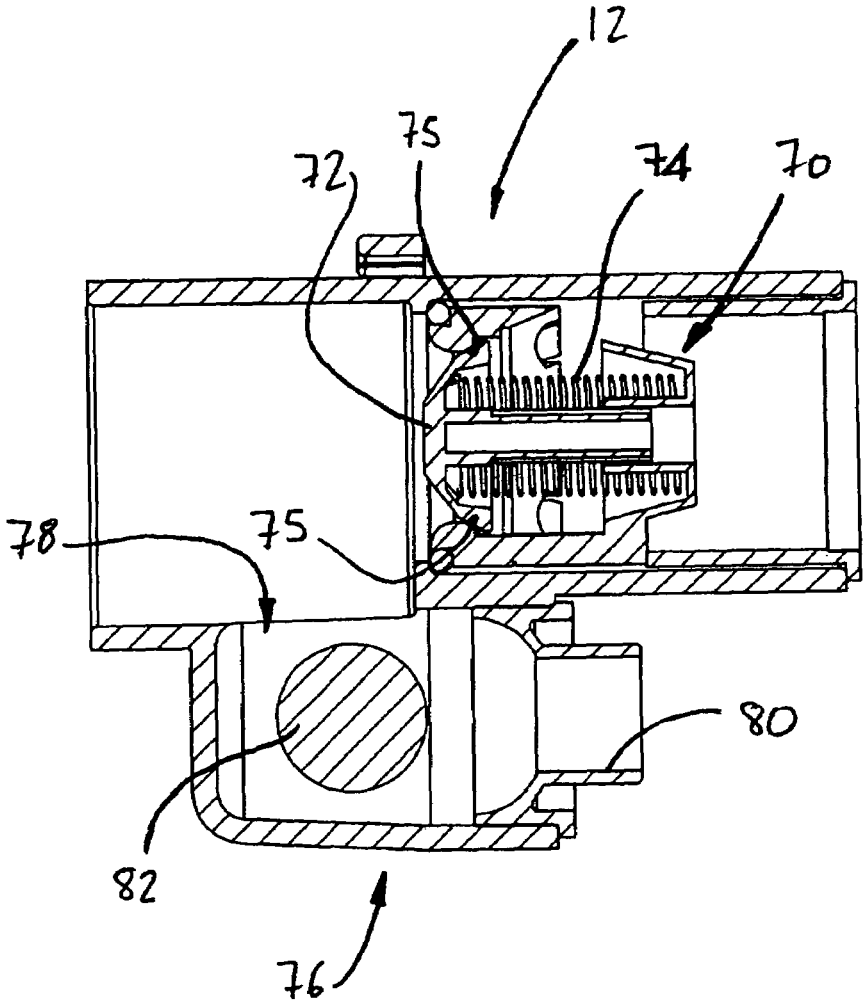
FIG. 8 is a cross-sectional view of the manifold, in accordance with a first embodiment of the present invention.

2. From the blower 10, the air, beforehand heated, is blown through the rigid or flexible pipe 18 to the manifold 12. The manifold 12 comprises many levels of security which can be installed individually or jointly, for example in the form of valves. These valves are:

a) a check valve (e.g., with a flap), as shown in FIGS. 7 and 8, which prevents the water from entering the blower 10 by a flap 72 held by a spring 74. In FIG. 7, the flap 72 is shown abutting against the seat 75 of the manifold 12, due to the biasing action of the spring 74. Accordingly, water coming from the downstream end of the manifold 12 is prevented from passing through the check valve 70 of the manifold 12.

b) a water relief valve which drains water is also provided in the manifold 12, as shown at 76 in FIGS. 7 and 8. Therefore, if water infiltrates the pipe which leads to the blower 10, for instance due to a failure of the check valve 70, the water relief valve 76 exhausts the infiltrated water. The water relief valve 76 has an inlet 78 below the check valve 70, such that water going upstream of the check valve 70 flows through the inlet 78 of the water relief valve 76 by the effect of gravity (i.e., the open position of the water relief valve 76). Water may then exit through outlet 80. A ball 82 is provided to close the outlet 80 during operation of the blower 10 (i.e., the closed position of the water relief valve 76), so as to generally prevent air pressure losses through the manifold 12; and/or c) a pressure relief valve, which holds the pressure from the blower 10 steady independently of the number of jets 14 installed, is generally shown at 90 in the manifold 12' of FIGS. 9A to 9C.

3. From the manifold 12 (or 12'), the air is blown through the flexible pipes 16 to each jet 14.

Figure 5:
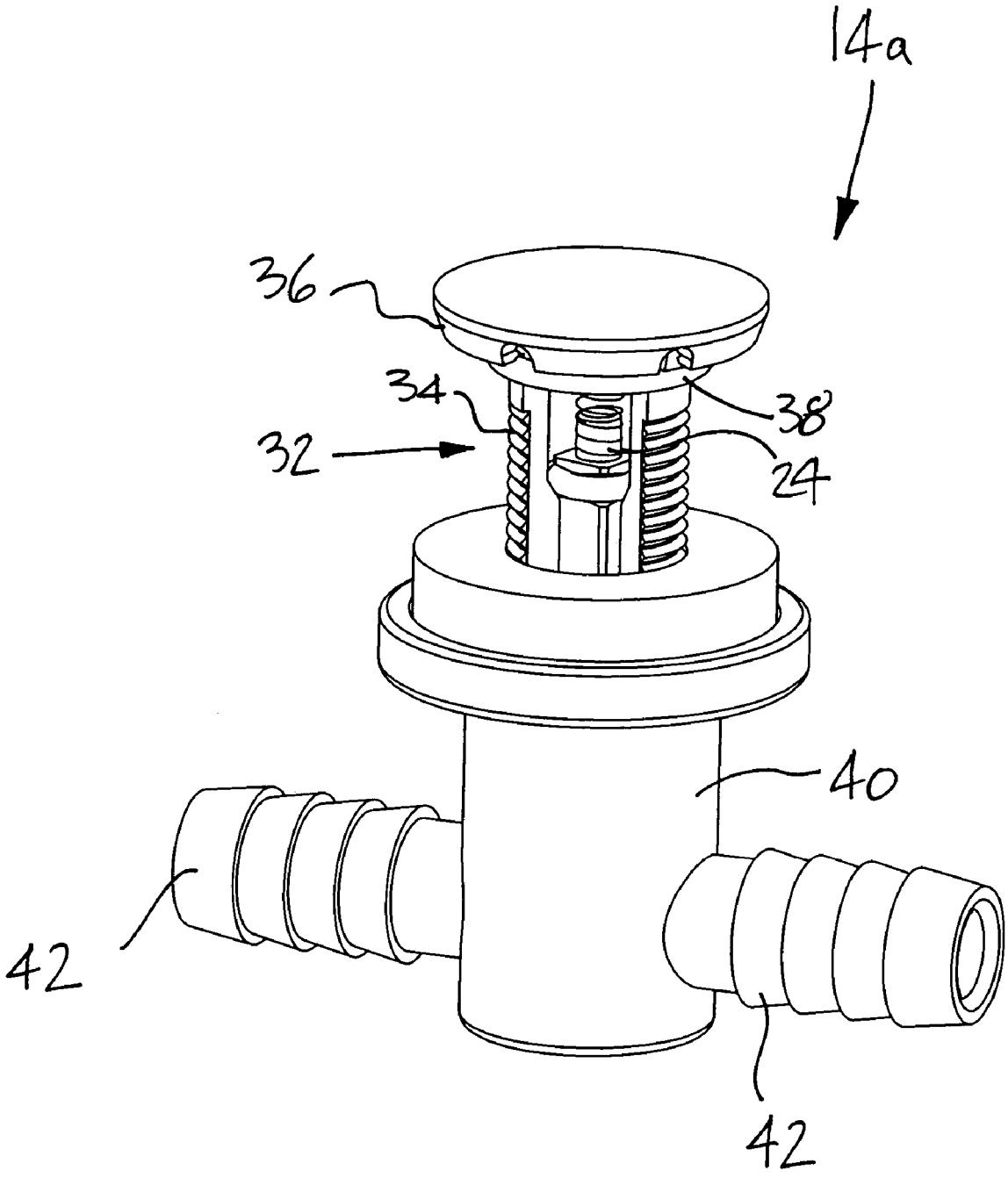
FIG. 5 is a schematic perspective view, partly in cross-section, of a water jet of the present air massage system, wherein a valve of the water jet includes a spring-loaded piston.
Figure 6:
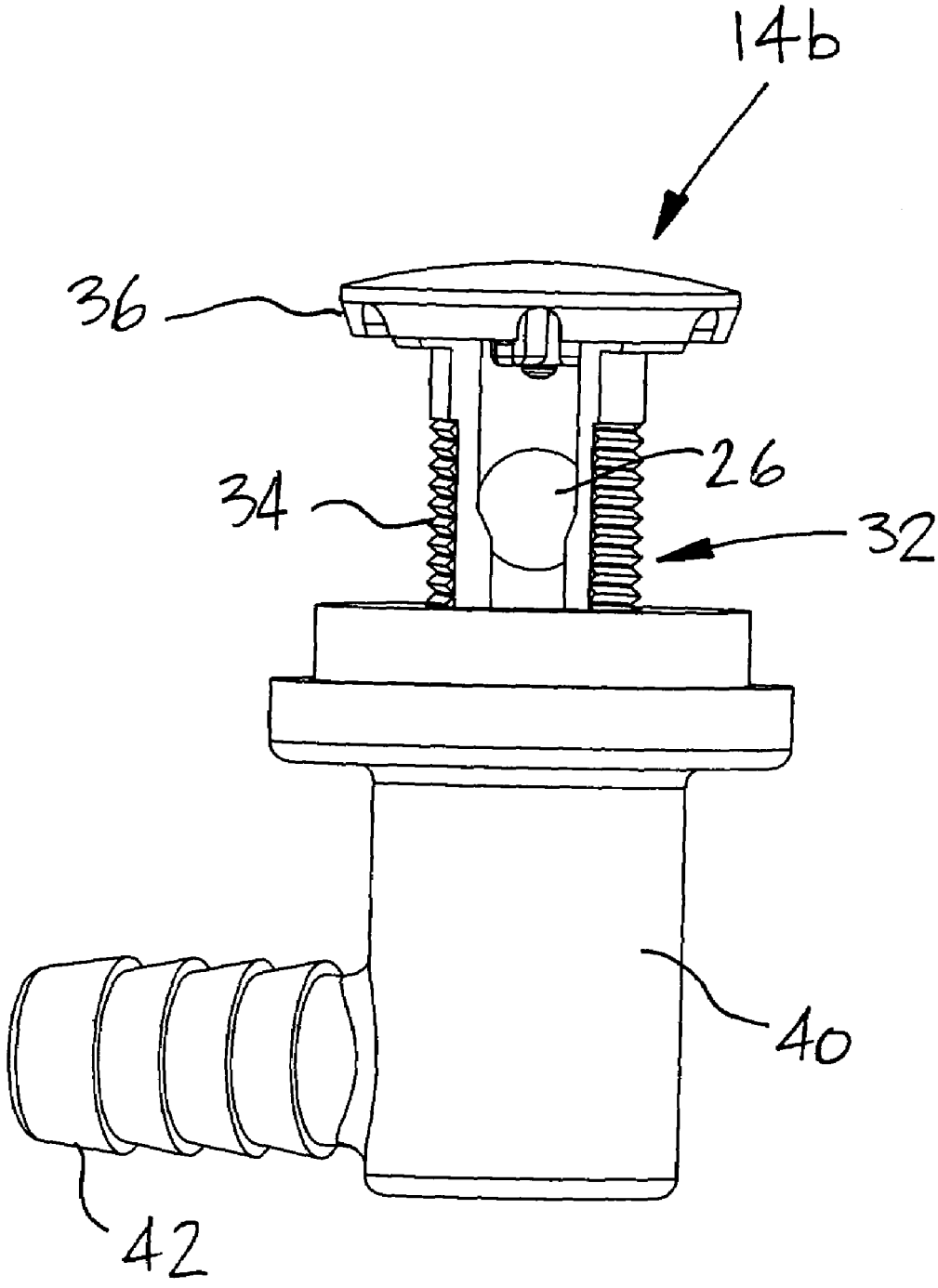
FIG. 6 is a schematic perspective view, partly in cross-section, of another water jet of the present air massage system, wherein the water air jet includes a ball valve.

The jets 14 may each include a water check valve which prevents water from infiltrating the flexible pipe 16. These water check valves may have a spring-loaded piston 24 (as in the jet 14*a* of FIG. 5), a glass, plastic or metal ball (as in the jet 14*b* of FIG. 6), a rubber flap or any other means to obtain the required water-tightness at the jet 14.

Figure 2:
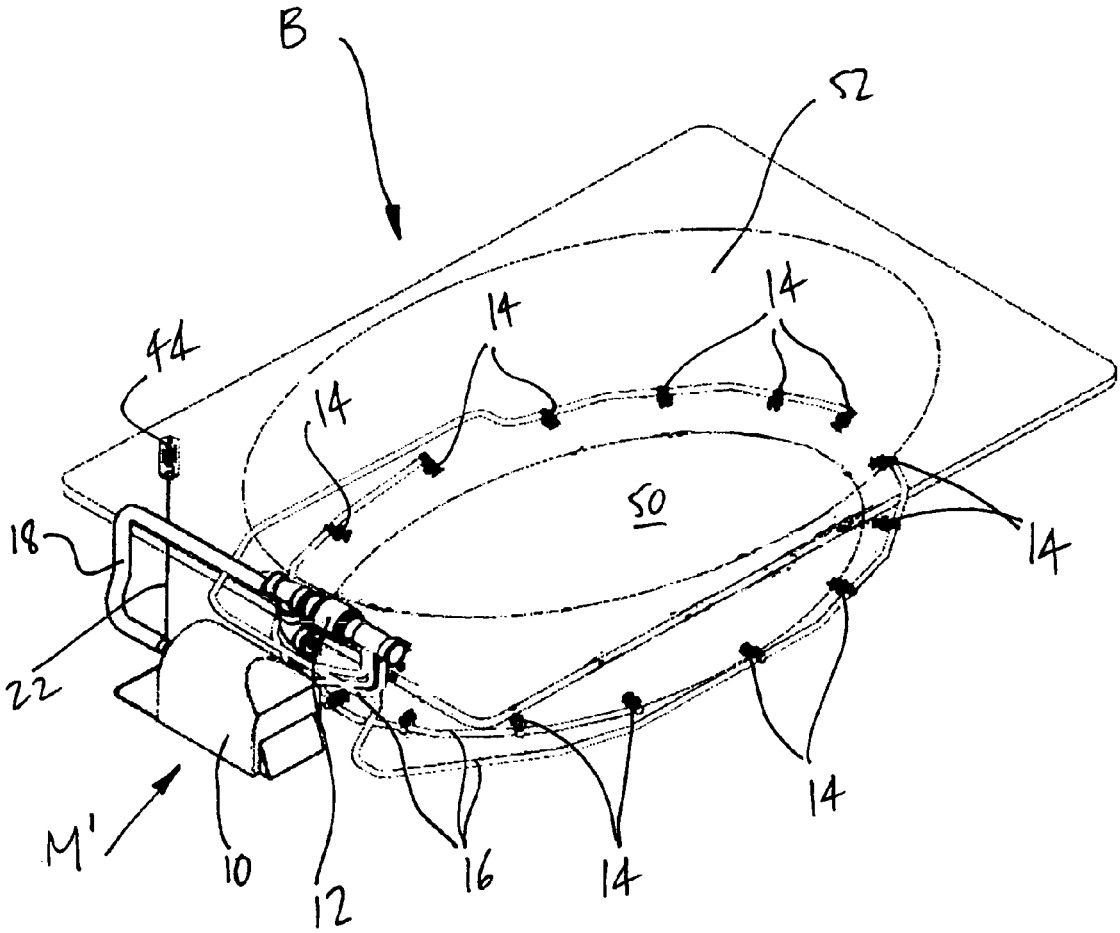
FIG. 2 is a schematic perspective view of part of a bathtub provided with a second air massage system in accordance with the present invention, wherein water jets of the system are provided on the sides of the bathtub.

The jets 14 are again located in the bottom 50 of the bathtub B (FIG. 1) or on the lateral walls 52 of the bathtub B (FIG. 2).

Others

Figure 3:
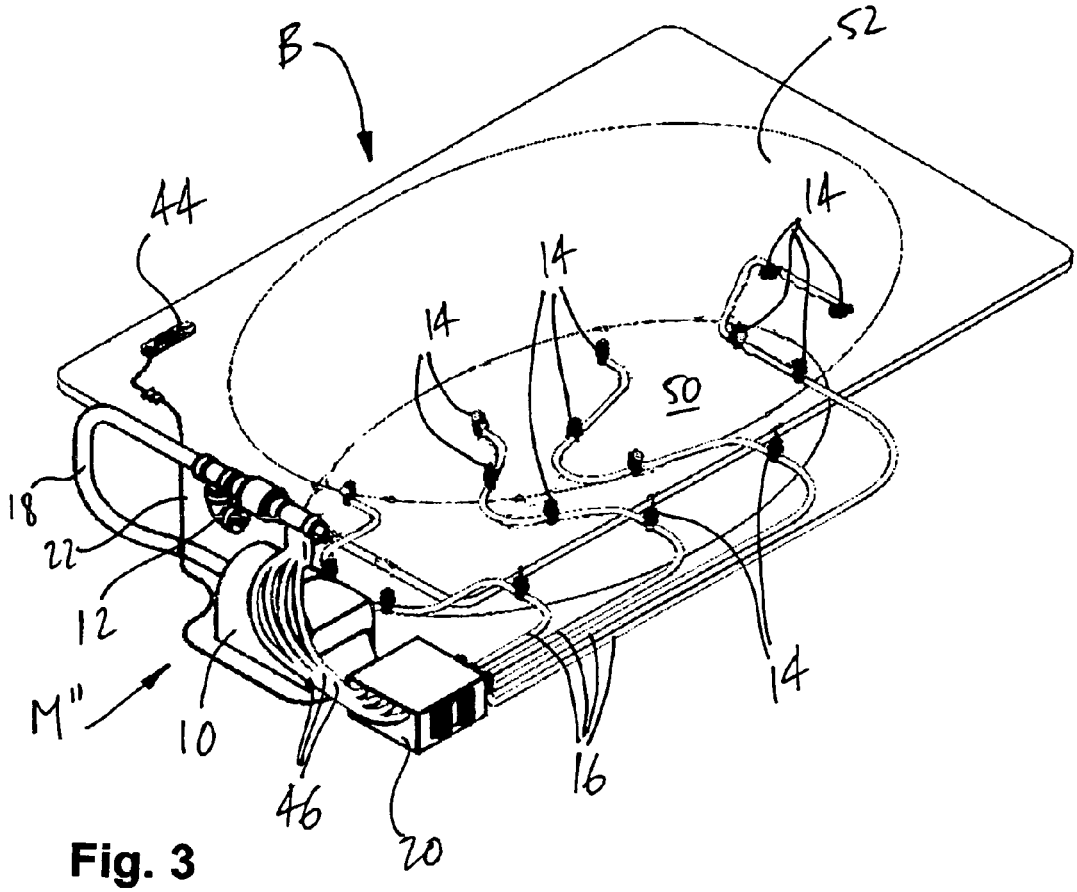
FIG. 3 is a schematic perspective view of part of a bathtub provided with a third air massage system in accordance with the present invention, wherein the system includes a sequencer.
Figure 4:
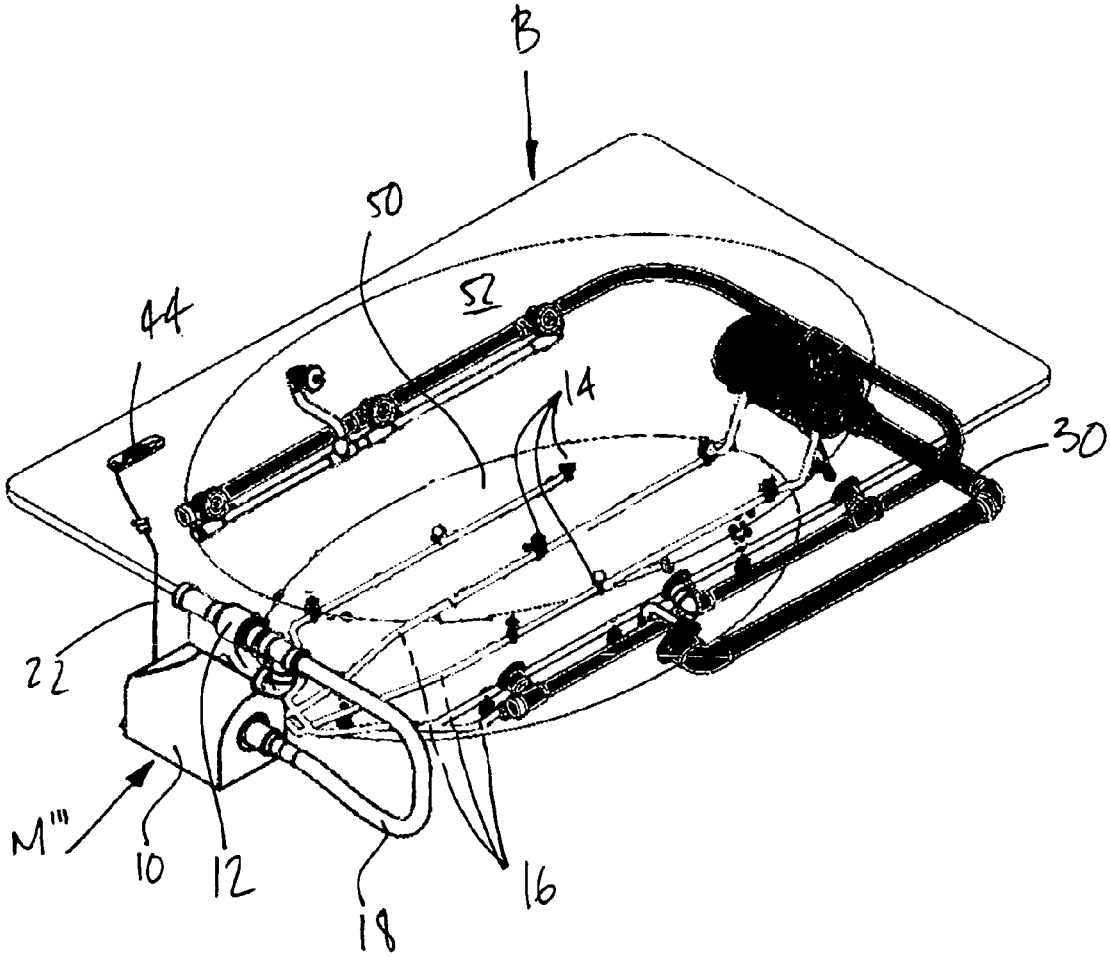
FIG. 4 is a schematic perspective view of part of a bathtub provided with a fourth air massage system in accordance with the present invention, in combination with a whirlpool system.

The air massage system may be installed in combination with a whirlpool system 30 (see the air massage system M''' and whirlpool system 30 of FIG. 4). The air massage system can also be installed with a sequence module 20 (see the air massage system M'' of FIG. 3) whose purpose is to open and close alternately a series of jets 14 in order to create a back and forth motion of air bubbles in the water (a wave effect). The use of a sequence module 20 will typically cause a pressure variation in the piping, whereby it is contemplated to use the manifold 12' having the pressure relief valve 90.

The jets 14 can be equipped with simple or double check valves or without valves if it is not required by the installation. For example, for jets 14 installed laterally (see FIG. 2), drainage may be achieved by gravity.

The valves of the jets 14 may be spring-loaded (see spring-loaded piston 24 in FIG. 5) with a stainless steel or plastic ball, magnetic, or with a rubber flap.

An additional valve can also be installed directly on the piping of the jet 14 to further ensure the water-tightness.

The jets 14 can be installed in an ergonomic way at the bottom 50 or on the lateral walls 52 of the bathtub B.

The jet 14 comprises a jet body 32 including a threaded hollow rod 34 with a flange 36 at its superior end under which is located an O-ring 38 whose purpose is to provide a seal with the interior finished surface of the bathtub B with the jet 14, a jet head or cap over or inside the flange 36 being the esthetic part visible from the interior of the bathtub B. The jet body 32 goes through the thickness of the bottom 50 or the lateral wall 52 of the bathtub B to then be connected to a piece serving as a locking nut and an elbow connector 40 provided with one or two inlets 42 (two inlets 42 being shown in the jets 14*a* of FIG. 5, and one inlet 42 being shown in the jet 14*b* of FIG. 6) adapted to be attached to one or two connectors for flexible tubes 16.

Figure 9A:
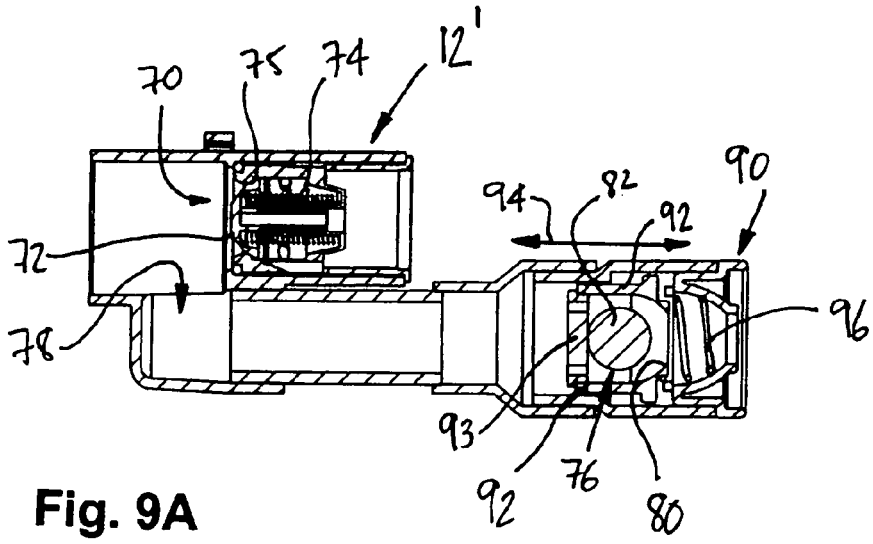
FIG. 9A is a cross-sectional view of a manifold in accordance with a second embodiment of the present invention, with a ball of a water relief valve in a position for allowing water to exit from the manifold.
Figure 9B:
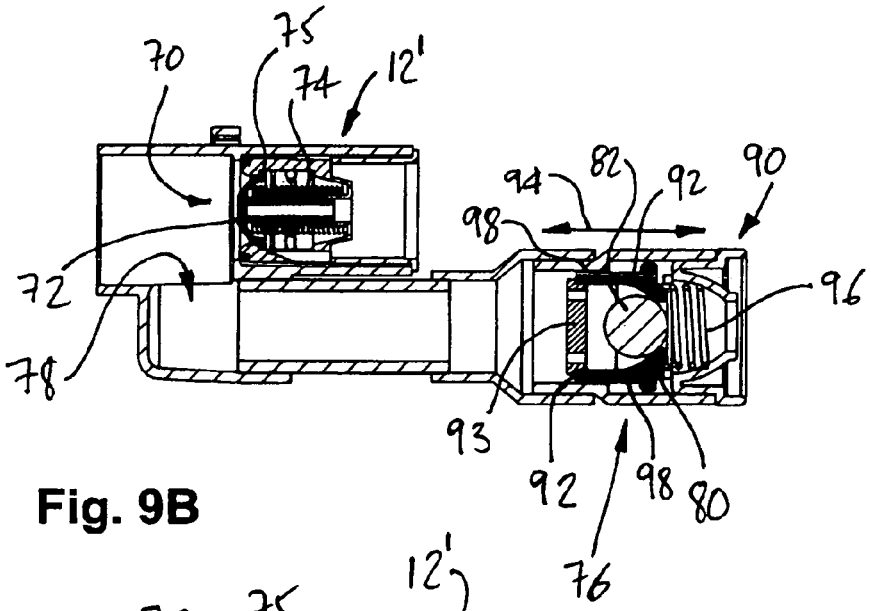
FIG. 9B is a cross-sectional view of the manifold of FIG. 9A, with the ball shutting the water relief valve outlet during normal operation of the manifold.
Figure 9C:
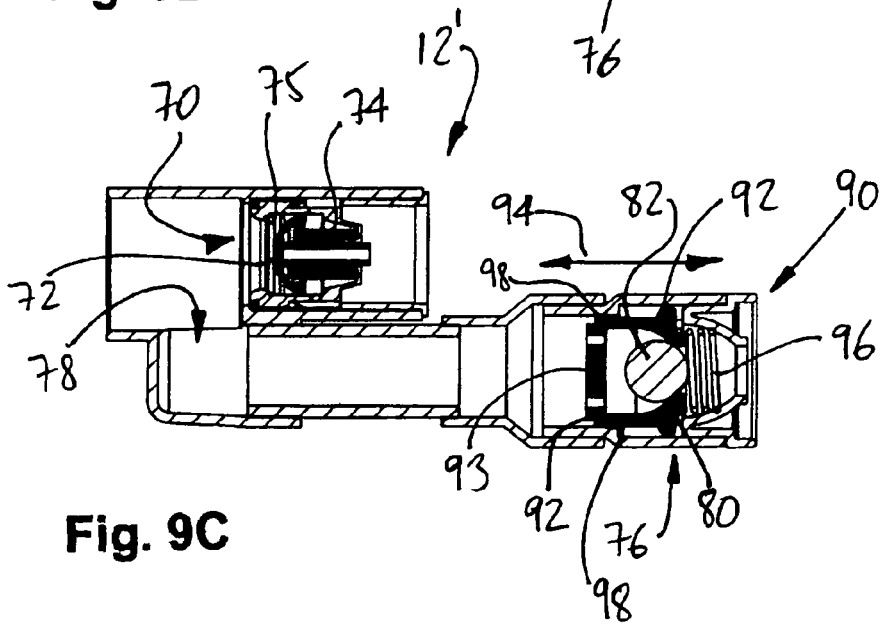
FIG. 9C is a cross-sectional view of the manifold of FIG. 9A, with the pressure relief valve exhausting air from the manifold.
Figure 10:
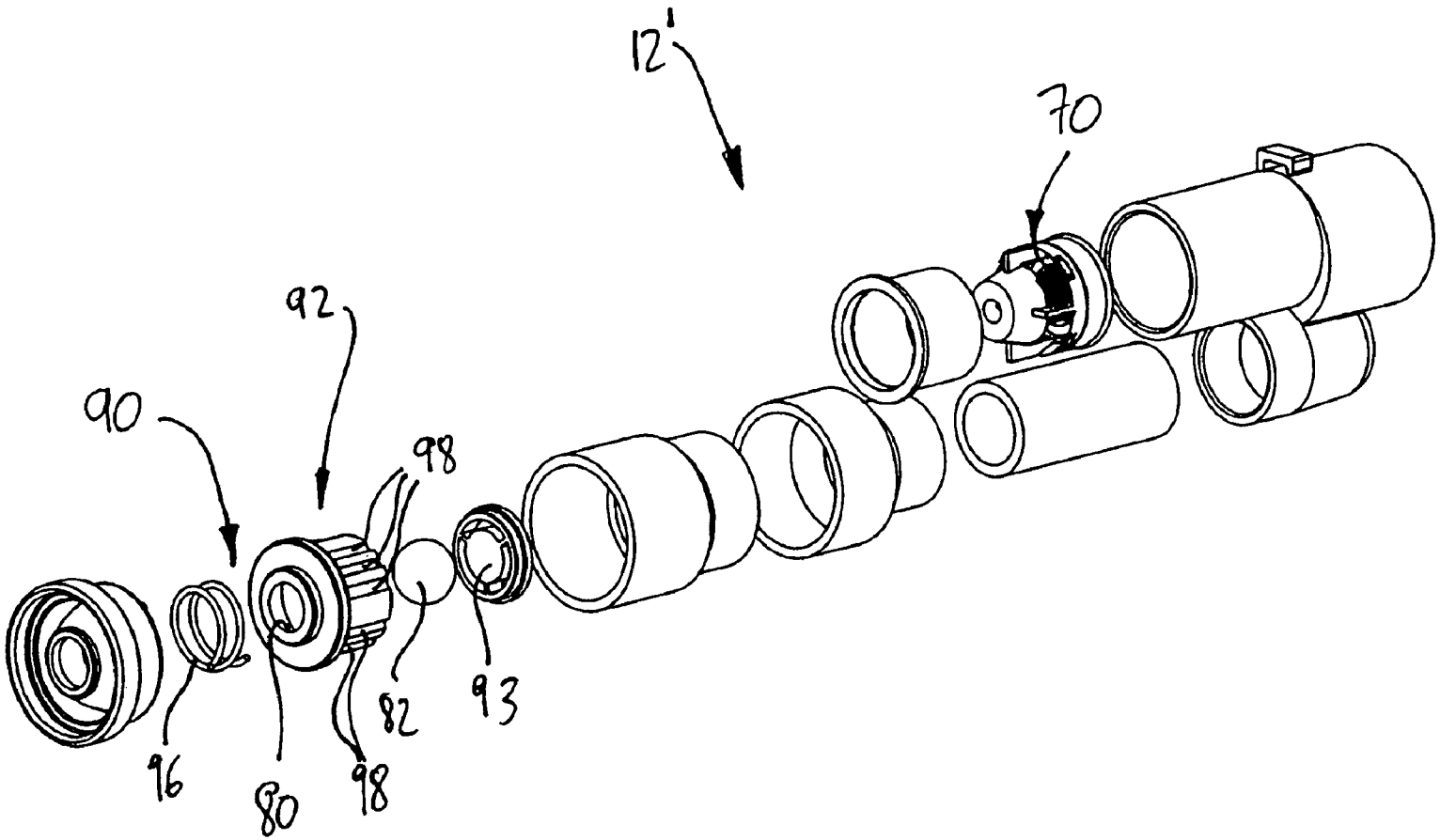
FIG. 10 is an exploded view of the manifold of FIG. 9A.

In order to make the system safe, two valves are included in the manifold 12, i.e., the check valve 70 and the water relief valve 76, as shown in FIGS. 7 and 8. A third valve, of pressure relief type, as shown at 90 in FIGS. 9A to 9C, can also be added in order to keep a steady pressure from the air propelled by the blower 10. In FIGS. 9A to 9C, the pressure relief valve 90 is installed at the end of the water relief valve 76. The manifold 12' of FIGS. 9A to 9C has the check valve 70 as well as the water relief valve 76. The ball 82 of the water relief valve 76 is positioned into a sleeve 92 and is held captive therein by a strainer 93, and is displaceable to block the outlet 80, as explained previously. The strainer 93 enables fluid to pass therethrough such that water may be drained from the manifold 12'. The sleeve 92 is displaceable along directions 94, and is biased to the position illustrated in FIG. 9A (i.e., shut position) by a spring 96 of the pressure relief valve 90.

A pressure build-up upstream of the ball 82 during operation, as is well illustrated in FIG. 9B by the ball 82 blocking the outlet 80, will cause the actuation of the pressure relief valve 90. More specifically, for a pressure build-up of a given magnitude, the pressure on the ball 82 and sleeve 92 will overcome the biasing force of the spring 96, such that the sleeve 92 moves to the position illustrated in FIGS. 9B and 9C (relief position), whereby air will be exhausted about the sleeve 92 (where axially-oriented air channels 98 are provided therefor) until the pressure is lowered to the given magnitude.

This pressure relief valve is optional for an installation having an amount inferior to twelve jets or to jets having much air restriction or to systems including a sequencer 20.

The blower 10 comprises an integrated heating element.

The electronic controller 22 operating the air massage systems M, M', M'' and M''' may be in a box independent from or included in the blower 10 according to the model.

The electronic controller 22 can be operated by an electronic or pneumatic touchpad 44.

The air pipe 18 connecting the manifold 12 to the blower 10 may be made of flexible or rigid piping.

The piping 16 connecting the manifold 12 to each jet 14 is preferably made of flexible pipe, but may also consist of a rigid pipe.

An air piping 16 can hold up to four air jets 14 interconnected one to the other in line.

An air massage system may be installed jointly with the whirlpool system, as seen in FIG. 4, where the air massage system M''' is shown in combination with the whirlpool system 30.

The air massage and whirlpool systems M''' and 30 are then operated by the same electronic controller but in an independent way to allow to use them together or separately.

An air sequencer 20 can be added to the air system (see the air massage system M'' of FIG. 3). The module of the sequencer 20 is equipped with four electromagnetic valves (although fewer or more electromagnetic valves could be used) which are operated by the electronic controller and that open and close each valve independently and in sequence to create a wave effect in the bathtub B.

The air system M'' with the air sequencer 20 can be installed jointly with a whirlpool system 30.

The present air systems and their versatility make them unique products. Furthermore, they can be installed on acrylic, fiberglass or stainless steel bathtub without modification in the fabrication of the bathtub itself.

As it has been conceived, the manifold 12 is unique on the market. It includes two security valves (i.e., the aforementioned check valve 70 and water relief valve 76) for water, and an optional pressure relief valve 90 for the blower 10.

Indeed, there is included two security valves: a check valve 70 and a water relief valve 76, the water relief valve 76 ensuring that if the check valve 70 does not work adequately, water cannot reach the blower 10 and provoke a short circuit but would be drained. In order to avoid air pressure loss during operation of the system, the water relief valve 76 is closed by air pressure by a glass, plastic or metal ball 82 (FIGS. 8, 9A to 9C) which will close the opening during the operation of the blower 10. It will then allow the drainage of the water when the blower 10 is stopped while preventing air pressure losses when the blower 10 is operating. However, if the air pressure becomes too high for the capacity of the blower 10, then the pressure relief valve 90, which can be added jointly or separately with the water relief valve 76, will open to balance out the air pressure and prevent the overheating of the motor of the blower 10.

Distribution of Jets

The jets 14 can be installed indifferently in the bottom 50 or on the lateral walls 52 of the bathtub B. At that level, the system which resembles the most the present system is the Ultra-Jet system; however, the jets of the latter do not offer the versatility of installation on the lateral walls and do not have check valves to ensure the hygiene of the system. The present jets 14 have the versatility to include or not distinct check valves (spring-loaded, ball or magnetic) and have many different designs, which makes the present jets 14 innovative by the flexibility to offer end users a multitude of jets according to the marketing orientation wanted thereby.

Piping

In the other systems, the piping which connects the blower to the manifold is always made of rigid materials. With the help of an adapter which we have specially conceived and which can be installed at the ends of the blower 10 and of the manifold 12, the present air massaging systems offer the possibility to install a flexible pipe 18, which allows to install the blower 10 fifteen feet from the bathtub B and thus reduce the noise during operation. The piping 16 which connects one jet 14 to another is also flexible, as opposed to what was existing before as rigid piping was used (reference Ultra-Jet). This made the installation of the previous system longer and more complicated.

Electronic Controller

The electronic controllers 22 are operated by way of a touch-pad 44 operating with an extra low voltage to protect the user against all electric discharge risks. Another innovation is the incorporation of an electronic timer to ensure the automatic stop of the blower 10 if forgotten by the user as well as an automatic drying cycle with water detection to ensure the hygiene of the system.

Combination of Air System/Whirlpool System

The present air massaging systems, with their great installation flexibility, allow to install any type of whirlpool system 30 to the same bathtub B as the air massaging system M''' and to be operated by the same electronic controller 22.

Sequencer

The present air massaging system M'' offers a sequencer 20 whose module comprises four electromagnetic valves which are activated individually and in a sequential way by an electronic control which also operates the blower 10, and thus without modification to the installation of the air massaging system, with the exception of the connection of flexible piping 46 of the manifold 12 to each electromagnetic valve of the sequencer 20 which is then connected to a line of three or four air jets 14 via flexible pipes 16.

Combination of Air System, Whirlpool System and Sequencer

The air massage systems M, M', M'' and M''', the sequencer 20 and whirlpool system 30 can be operated by the same electronic controller.

The invention claimed is:

1. An air massage system for a bathtub comprising a blower, an air distributor, and water jets, said air distributor being adapted to connect said blower to said jets, said jets being adapted to deliver air under pressure to the cavity defined by the bathtub, said air distributor comprising a manifold having a water check valve for generally preventing water from reaching said blower, and at least one water relief valve for draining water from said manifold, in the event that water infiltrates said manifold upstream of the water check valve in said manifold, said water relief valve defining an outlet and comprising a ball being displaceable between open and closed positions, said outlet being closed by said ball in said closed position by air pressure of said blower for preventing air pressure losses during said operation, said ball moving away from said opening when the blower is stopped to allow water to flow through said outlet in said open position for allowing the drainage of water that has infiltrated said air distributor.

2. An air massage system as defined in claim 1, wherein said air distributor comprises a main pipe, said manifold and distribution pipes, said main pipe connecting said blower to said manifold and said distribution pipes connecting said manifold to said jets.

3. An air massage system as defined in claim 1, wherein each said jet has a water check valve.

4. An air massage system as defined in claim 1, wherein a pressure relief valve is provided upstream of said jets for keeping a substantially steady pressure from the air propelled by said blower.

5. An air massage system as defined in claim 4, wherein said pressure relief valve is provided at the end of said water relief valve.

6. An air massage system as defined in claim 4, wherein said water relief valve is displaceable between open and closed positions, said water relief valve being adapted to adopt said closed position by air pressure from said blower during said operation, and being adapted to adopt said open position when said blower is stopped for allowing the drainage of water that has infiltrated said air distributor, wherein said pressure relief valve is adapted to open in the event that said air pressure becomes too high for a capacity of said blower for preventing the overheating of a motor of said blower.

7. An air massage system as defined in claim 1, wherein said manifold has a first conduit in which the check valve is positioned, and a second conduit in fluid communication with the first conduit through an inlet of the second conduit, with the ball being positioned in the second conduit, the second conduit having an outlet for the drainage of water.

8. An air massage system as defined in claim 7, wherein the inlet of the second conduit is positioned downstream of and adjacent to the check valve, and in a bottom wall of the second conduit, whereby water bypassing the check valve is drained through the inlet of the second conduit by gravity.

9. An air massage system as defined in claim 8, wherein the water relief valve has a ball displaceable in the second conduit to block the outlet when the blower is activated.

* * * * *